United States Patent [19]

Hata et al.

[11] Patent Number: 4,682,962

[45] Date of Patent: Jul. 28, 1987

[54] METHOD OF MANUFACTURING A CATHODE RAY TUBE

[75] Inventors: Katsuhiko Hata; Hisao Ohashi; Keiji Honda; Takahiko Yamakami, all of Aichi, Japan

[73] Assignee: Sony Corporation, Tokyo, Japan

[21] Appl. No.: 886,958

[22] Filed: Jul. 24, 1986

Related U.S. Application Data

[63] Continuation of Ser. No. 657,124, Oct. 3, 1984, abandoned.

[30] Foreign Application Priority Data

Oct. 7, 1983 [JP] Japan ..... 58-188857

[51] Int. Cl.[4] ..... H01J 9/44

[52] U.S. Cl. ..... 445/5

[58] Field of Search ..... 445/5, 6

[56] References Cited

U.S. PATENT DOCUMENTS

| | | | |
|---|---|---|---|
| 3,323,854 | 6/1967 | Palac | 445/5 X |
| 4,214,798 | 7/1980 | Hopen | 445/5 |
| 4,326,762 | 4/1982 | Hockenbrock et al. | 445/5 |

*Primary Examiner*—Kenneth J. Ramsey

*Attorney, Agent, or Firm*—Hill, Van Santen, Steadman & Simpson

[57] ABSTRACT

A method of manufacturing a cathode ray tube wherein DC and AC voltages are superimposed and applied to a cathode ray tube between a high voltage electrode and a low voltage electrode with the high voltage electrode being at the high voltage side of the DC voltage so as to perform knocking treatment. The superimposed DC and AC voltages may be alternately applied in various manners so as to provide improved knocking of the tube.

2 Claims, 8 Drawing Figures

METHOD OF MANUFACTURING A CATHODE RAY TUBE

This is a continuation of application Ser. No. 657,124, filed Oct. 3, 1984, now abandoned.

BACKGROUND OF THE INVENTION

1. Field of the Invention

The present invention relates in general to a method of manufacturing a cathode ray tube and particularly to a novel knocking method.

2. Description of the Prior Art

In the manufacture of cathode ray tubes such as television picture tubes, metal electrodes which form the electron gun within the cathode ray tube body after being assembled in the cathode ray tube have projections such as flash which is produced during the press forming. Uneven surfaces, dust which adheres to the elements during various processes cause unstable charges to be generated when the cathode ray tube is operating. So as to eliminate such disadvantages it has been known in the prior art to conditionally treat the tube elements by applying a high voltage between a high voltage electrode and a low voltage electrode so as to generate discharges by formation of a strong electric field so as to remove the unstable structure and dust such as flash. This is called "knocking" and as illustrated in FIG. 1, the knocking treatment is performed by applying between an anode button 2 and a terminal pin 4 which is at a low voltage, a high voltage source. The anode button 2 is connected to high voltage electrodes within the tube and the terminal pin 4 is connected to low voltage elements mounted within the neck portion of the cathode ray tube 1 as for example, within the electron gun 3.

The electron gun 3 may be formed in various manners and may, for example, have a unipotential type electron gun illustrated in FIG. 2 which has a first grid G1, a second grid G2, a third grid which is a first anode G3, a fourth grid G4 and a fifth grid which is the second anode G5. Each of the grids may be a metal electrode of cup or cylindrical shape. The third grid G3 and the fifth grid G5 are high voltage electrodes and are electrically connected together and to the anode button 2. The other grids G1, G2 and G4 are electrically connected together and to the terminal pin 4 which extends from a stem of the neck portion of the tube.

So as to perform knocking treatment as described in FIG. 1 to the electron gun in such arrangements, the knocking voltage 5 is applied to the button which is connected to the third grid G3 and the fifth grid G5 of the electron gun 3 and the low voltage electrodes G1, G2 and G4. The knocking voltage source 5 may supply either DC voltage or half wave rectified AC voltage. Usually the knocking treatment is performed by applying DC voltage and AC voltage alternately. However, the method of alternately applying the AC voltage and the DC voltage still does not provide sufficient knocking effect. When DC voltage is used in the knocking treatment, constant high voltage HV is supplied between the high voltage electrodes and the low voltage electrodes continuously as shown in the wave form illustrated in FIG. 3. Alternatively, the DC voltage may be repeatedly applied at regular intervals. In knocking treatment using half wave rectified AC voltage, such as illustrated in FIG. 4, the half wave rectified pulses at a frequency of 60 Hz for example is applied between the high and low voltage electrodes.

When using DC voltage for the knocking treatment, the discharge energy is high because the impedance is low and the effective voltage is high. However, discharges will be generated only at portions having large flash or portions where a large electrical field intensity exists as, for example, between the third grid G3 and the fourth grid G4, or between the fourth grid G4 and the fifth grid G5, or between the second grid G2 and the third grid G3. Also, when using DC voltage, the number of discharges will be small and in other words, the so-called discharge inducing power is small and the overall conditioning of the tube is insufficient.

So as to obtain sufficient conditioning effect using DC knocking treatment, the DC voltage may be increased or the time of applying the voltage may be lengthened. For these conditions however, sputtering of metal materials from the electrode is produced and thereby secondary faults may occur due to the adhesion of the sputtered metal to the inner walls of the neck portion of the cathode ray tube body and damages of various elements 6 mounted close to the electron gun within the neck may occur and also short circuit faults may occur. For example, in cathode ray tubes of the Trinitron (registered trademark) type, a convergence means is mounted in the rear portion of the electron gun. The convergence means is usually supplied with a high voltage from the anode button 2 with the voltage being divided by a bleeder resistor. The bleeder resistor is mounted within the narrow neck portion between the electron gun 3 and the inner wall of the tube. If sputtering is produced as described above, the impedance of the bleeder resistor may be decreased or destroyed.

On the other hand, if knocking treatment uses half wave rectified AC voltage, the discharge energy is weak because the impedance is high and the effective voltage is low. Since the impedance is high and the high frequency component is large, the discharge inducing power is strong and discharges will be generated between the electrodes. However, since the discharge energy is weak, sufficient conditioning effect does not occur to the various electrodes.

Thus, even if DC knocking and AC knocking methods are alternately performed sufficient conditioning does not result and the knocking treatment is not successful. Thus, when completed cathode ray tubes of the prior art are assembled and operated in a television receiver for example unstable discharges may occur during the working state.

SUMMARY OF THE INVENTION

It is an object of the present invention to provide a method of manufacturing cathode ray tubes wherein a knocking treatment is effectively performed at relatively low applied voltages.

In a manufacturing process of cathode ray tubes, according to the invention, there is applied superposed DC voltage and AC voltage which may be half-wave rectified between the high voltage electrodes and the low voltage electrodes of the cathode ray tube with the positive voltage side of the applied voltage applied to the high voltage electrode so as to accomplish knocking.

The high value of the applied voltage which comprises the superposed AC and DC voltage may be selected to be in the range of 50 to 70 kV and the voltage ratio of the AC component to the DC component may be selected to be in the range from 4:1 through 0.5:1 and preferably in the range of 2:1 through 1:1.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
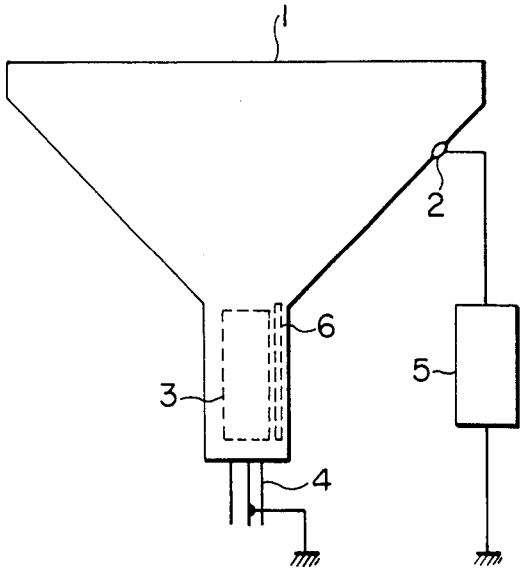
FIG. 1 is a view illustrating the manufacturing method for a cathode ray tube of the prior art.
Figure 2:
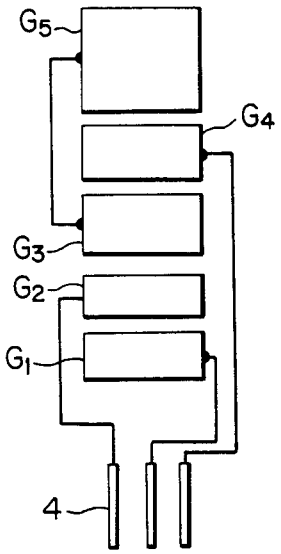
FIG. 2 is a block diagram of an electron gun in a cathode ray tube.
Figure 3:
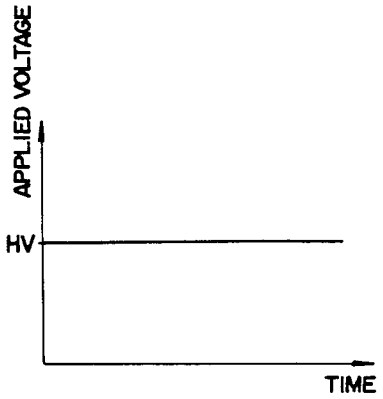
FIG. 3 is a graph illustrating an applied DC voltage.
Figure 4:
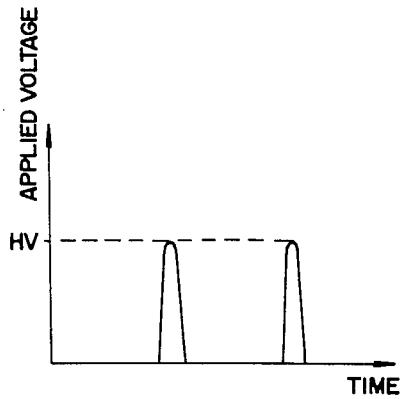
FIG. 4 is a graph illustrating half-wave rectified AC voltage.
Figure 5:
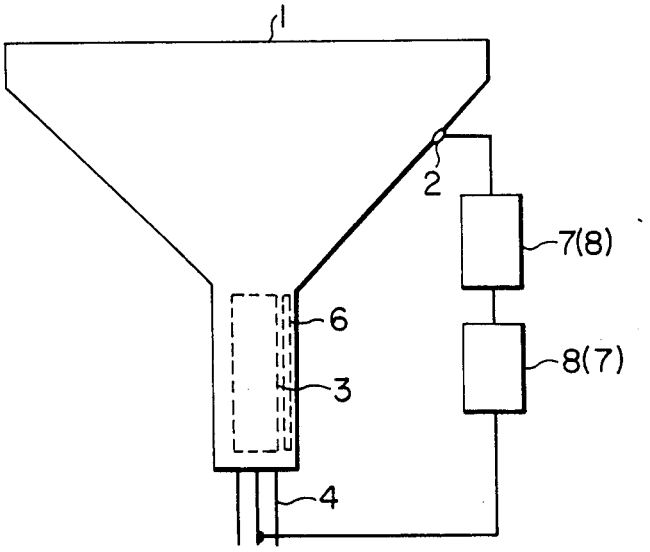
FIG. 5 is a view illustrating an example of the manufacturing method of a cathode ray tube according to the invention.

FIG. 5 illustrates the embodiment of the invention and those elements designated by common numerals in FIG. 5 comprise the same elements as illustrated in FIG. 1. For example, the cathode ray tube has an electron gun 3 which has grids G1, G2, G3, G4, and G5 as illustrated in FIG. 2. Between the anode button 2 which is connected to the first and second anodes G3 and G5 and the terminal pin 4 which is connected to the low voltage electrodes G1, G2 and G4 are connected a DC high voltage source 7 and an AC power source 8. The AC source may in one embodiment produce half-wave rectified AC power. The voltage sources 7 and 8 are connected in series, for example. The voltage applied to anode button 2 is the high voltage or positive polarity and this is applied to the high voltage electrodes G3 and G5 wherein the low voltage side of the combined voltage from the sources 7 and 8 are applied to pin 4. The polarity of the AC voltage source with respect to the DC source and the order of the series connection between the sources 7 and 8 can be arbitrarily selected. The superimposed voltages from the sources 7 and 8 are supplied to the cathode ray tube in different manners as can be illustrated, for example, in FIGS. 6 or 7.

Figure 6:
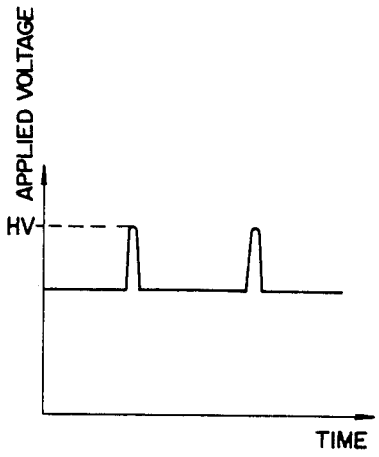
FIG. 6 is a graph illustrating an applied DC and superimposed half-wave rectified AC voltage with the AC voltage adding to the DC voltage.
Figure 7:
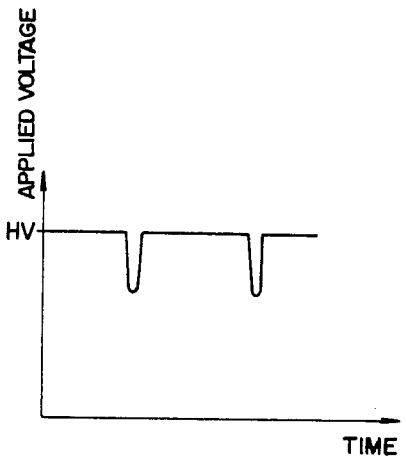
FIG. 7 is a graph illustrating superimposed DC voltage and half-wave rectified AC voltage with the AC voltage subtracting from the DC voltage.

Thus, in FIG. 6, the applied voltage is indicated as a DC voltage of a first level indicated by the generally horizontal solid line and the AC half-wave rectified voltage is indicated by the positive peaks which are superimposed upon the DC voltage. It is to be realized that although the half-wave rectified AC voltage is illustrated in FIG. 6 that a full wave AC voltage may be superimposed on the DC voltage and this would give the wave form illustrated in FIG. 8. The waveform of FIG. 6 is where the positive cycles of the rectified AC voltage are applied to the DC voltage and the example of FIG. 7 is where the negative going peaks of the AC voltage are superimposed on the DC voltage.

Thus, according to the methods of the invention, which apply a combination of AC and DC voltage to the button 2 and the contact 4 will result in sufficient discharge being generated between the electrodes of the electron gun 3 and projections such as flash or dust so that they will be effectively removed therefore conditioning the tube so it will perform well. Also, the conditioning at the inner wall of the neck of the tube will be well performed which cannot be accomplished in the prior art methods. Also, the condition can be well performed even on parts 6 mounted within the neck as, for example, a bleeder resistor formed by an insulation substrate coated with a resistive layer thereon. Thus, according to the methods of the invention, when the knocking voltage is applied between the anode button 2 and the terminal pin 4 surface creepage appears to be produced at the inner wall of the neck of the tube and on the surface of the bleeder resistor so as to result in conditioning effect.

The knocking voltage is produced by a superposition of the DC voltage and the AC voltage given in the above examples. In some cases, however, the knocking treatment using superimposed voltage which will hereafter be described as the first type of knocking treatment may be combined with a knocking treatment using only AC voltage hereinafter referred to as the second type knocking treatment. Furthermore, the superimposed voltage may be combined with a knocking treatment using DC voltage hereinafter referred to as a third type of knocking treatment. For example, one method comprises the steps of second type knocking treatment at the first period, third type knocking treatment at the first period, first type knocking treatment at the first period, third type knocking treatment at the second period, second type knocking treatment at the second period.

That means there are two times of second knocking treatments, two times of third knocking treatments and one first knocking treatment which is performed in each of the five periods. The high voltage for the third type knocking treatment is selected to be 50 kV volts.

A prior art method comprises the steps of second type knocking treatment at the first period, third type knocking treatment at the first period, second type knocking treament at the second period, third type knocking treatment at the second period second type knocking treatment at the third period for a longer time as a whole.

There are three times of second knocking treatments and two times of third knocking treatments which are performed in each of the five periods.

The total of all five periods in the prior art is longer than that in this invention.

Even if a sufficient DC voltage is selected such as 55 kV is used, the conditioning will be insufficient.

The electron gun is not limited in this invention to unipotential type electron gun such as illustrated in FIG. 2 but various configurations as, for example, bipotential type guns comprising first through fourth grids G1–G4 may be utilized.

Figure 8:
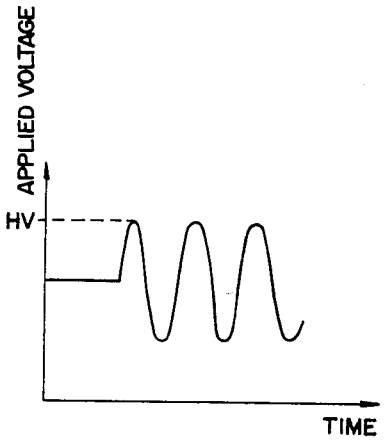
FIG. 8 is a graph illustrating superimposed DC voltage and AC voltage.

The supply source of the knocking voltage is not limited to embodiments where the DC component and the AC component are respectively obtained from sources 7 and 8 but a single power source may be used which provides voltages of either of the waveforms illustrated in FIGS. 6, 7 and 8.

In the present invention, treatment is performed with a knocking voltage comprising superposed DC and AC voltages. In this construction, sufficiently high discharge can be generated between electrodes of the electron gun and conditioning will be performed very well on the electrodes. Since the conditioning is well performed, the DC voltage need not be increased a large amount and sputtering of the electrode will not be produced which occurs with very high DC voltages as used in the prior art. Thus, faults due to metal adhesion to the inner wall of the neck portion of the cathode ray tube caused by sputtering will not occur. Furthermore, damage of inside parts such as bleeder resistors and the generation of cracks in the neck portion of the tube will be avoided. The effective conditioning makes it possible to reduce the knocking time as a whole and to improve the rate of production of tubes. Since the conditioning can be performed on the inner wall of the neck portion of the cathode ray tube, the dark current will be increased and the ability to withstand higher voltages will be improved.

If the high value of the applied voltage comprising the superposition of the AC and the DC voltage is selected to be in the range of 50–70 kV then the voltage ratio of the AC component to the DC component will be selected to fall within the range of 4:1 through 0.5:1 and preferably within the range of 2:1 through 1:1.

Although the invention has been described with respect to preferred embodiments, it is not to be so limited as changes and modifications may be made therein which are within the full intended scope as defined by the appended claims.

We claim as our invention:

1. A method of performing a knocking treatment to a cathode ray tube having low and high voltage electrodes comprising a first step of applying an alternating voltage between said low and high voltage electrodes and a third step of applying a superimposed voltage comprising a high direct current voltage and an alternating voltage to said low and high voltage electrodes with the positive potential of said superimposed voltage being connected to said high voltage electrodes and wherein said alternating voltage is a half wave rectified voltage, the high value of said superimposed voltage is in the range of 50 to 70 kilovolts and the ratio of the alternating to the direct voltage is in the range of 4:1 to 0.5:1, and a second step of applying a direct current voltage between said low and high voltage electrodes which occurs between said first and third or said third and first step.

2. A method of performing a knocking treatment to a cathode ray tube having low and high voltage electrodes comprising a first step of applying an alternating voltage between said low and high voltage electrodes and a following second step of applying a superimposed voltage comprising a high direct current voltage and an alternating voltage to said low and high voltage electrodes with the positive potential of said superimposed voltage being connected to said high voltage electrodes and wherein said alternating voltage is a half wave rectified voltage, the high value of said superimposed voltage is in the range of 50 to 60 kilovolts and the ratio of the alternating to the direct voltage is in the range of 4:1 to 0.5:1.

* * * * *

UNITED STATES PATENT AND TRADEMARK OFFICE

CERTIFICATE OF CORRECTION

PATENT NO. : 4,682,962

DATED : July 28, 1987

INVENTOR(S) : Hata et al

It is certified that error appears in the above-indentified patent and that said Letters Patent is hereby corrected as shown below:

COLUMN 6

Claim 2, line 29, change "60 kilovolts" to --70 kilovolts--.

Signed and Sealed this

Fourth Day of October, 1994

*Attest:*

*Attesting Officer*

Bruce Lehman

BRUCE LEHMAN

*Commissioner of Patents and Trademarks*